US007390160B2

(12) United States Patent
Blatchford et al.

(10) Patent No.: US 7,390,160 B2
(45) Date of Patent: Jun. 24, 2008

(54) AXIAL FLOW STEAM TURBINE ASSEMBLY

(75) Inventors: David Paul Blatchford, Rugby (GB); Philip David Hemsley, Rugby (GB)

(73) Assignee: Alstom Technology Ltd, Baden (CH)

( * ) Notice: Subject to any disclaimer, the term of this patent is extended or adjusted under 35 U.S.C. 154(b) by 507 days.

(21) Appl. No.: 11/189,638

(22) Filed: Jul. 26, 2005

(65) Prior Publication Data

US 2006/0024156 A1 Feb. 2, 2006

(30) Foreign Application Priority Data

Jul. 29, 2004 (GB) ..... 0416931.4

(51) Int. Cl.
*F01D 1/00* (2006.01)

(52) U.S. Cl. ..... 415/1; 415/199.5

(58) Field of Classification Search ..... 415/199.5
See application file for complete search history.

(56) References Cited

U.S. PATENT DOCUMENTS

| | | | | |
|---|---|---|---|---|
| 5,308,227 | A | 5/1994 | Gros et al. | 416/219 R |
| 5,328,326 | A | 7/1994 | Gros et al. | 415/115 |
| 6,305,901 | B1 | 10/2001 | Bell et al. | 415/100 |
| 7,186,074 | B2 * | 3/2007 | Blatchford et al. | 415/100 |

FOREIGN PATENT DOCUMENTS

| | | |
|---|---|---|
| CH | 41159 | 9/1908 |
| FR | 2 594 176 | 8/1987 |
| GB | 471869 | 9/1937 |

OTHER PUBLICATIONS

F. Kreitmeier et al.: "Proaktive Produkt- und Prozeβqualifikation in der Dampfturbinenentwicklung", ABB Technik 4, 1998, Baden, Switzerland, pp. 37-47 (see brief translation of German Search Report for DE 10 2005 033 362.1).
German Search Report for DE 10 2005 033 362.1, Nov. 7, 2005 (4 pages) and brief translation thereof (1 page).
Great Britain Search Report for GB 0416931.4.
U.S. Patent Application entitled "Axial Flow Steam Turbine Assembly" filed on the same date as the present application.

* cited by examiner

*Primary Examiner*—Richard Edgar
(74) *Attorney, Agent, or Firm*—Darby & Darby

(57) ABSTRACT

A turbine, e.g., a high pressure (HP) turbine, has a conventional drum-type structure with reaction turbine stages. A preceding or following turbine, e.g. an intermediate pressure (IP) turbine, on a common axis and on the same steam path, has rotor drum which carries an annular row of moving blades having root portions held within a slot in the periphery of the drum. A turbine casing surrounds the drum and carries a static blade assembly with an annular row of static blades which, together with the annular row of moving blades, constitutes a modified turbine stage. The static blade assembly has a radially inner static ring with a radially inner side confronting the periphery of the drum. A seal acts between the inner static ring and the rotor. The static blade assembly has an outer static ring which has a substantially greater thermal inertia and stiffness then the inner static ring and which is capable of sufficient sliding relative to the casing in a radial sense to accommodate relative thermal expansion and contraction of the outer static ring and the turbine casing.

24 Claims, 12 Drawing Sheets

AXIAL FLOW STEAM TURBINE ASSEMBLY

Priority is claimed to United Kingdom Patent Application No. GB 041 6931.4, filed Jul. 29, 2004, the entire disclosure of which is incorporated by reference herein.

The present invention relates to axial flow steam turbine assemblies that include at least two turbines.

BACKGROUND

Steam is supplied to a turbine at high pressure and temperature from a boiler and the energy in the steam is converted into mechanical work by expansion through the turbine. The expansion of the steam takes place through a series of static blades or nozzles and moving blades. An annular row of static blades or nozzles and its associated annular row of moving blades is referred to as a turbine stage. After the steam has been expanded in a high pressure (HP) turbine, it is conventional to return it to the boiler for re-heating and then to return the steam to an intermediate pressure (IP) turbine, from which the steam exhausts through one or more low pressure (LP) turbines. Usually the turbines are arranged on a common shaft, but sometimes turbine assemblies are designed in which the HP and IP or LP turbines rotate at different speeds, either by using a gearbox or by connecting two shaft lines to different generators.

An impulse turbine stage is one in which all or most of the stage pressure drop takes place in the row of static blades. The steam jet produced does work on the rotor of the turbine by impinging on the following row of moving blades. In practice, impulse stages are designed with a small pressure drop over the moving blades (e.g. 5-20% degree of reaction, which is the percentage of the stage enthalpy drop taken over the moving blades).

A reaction turbine stage is one in which a substantial part (e.g. roughly half or more) of the stage pressure drop takes place over the row of moving blades. For example, reaction blading may be designed with a 50% degree of reaction, which gives approximately equal pressure ratios over the static and moving rows.

In a turbine with impulse blading, it is conventional to use a disc-type rotor, the static blade assemblies constituting diaphragms that extend into chambers between the rotor discs. The diaphragms extend radially inwards to a small diameter, for efficient sealing against the rotor due to the smaller leakage flow area.

In a turbine with reaction blading, the pressure drop over the static blade assembly is considerably less than over the static blade assembly of an impulse stage, and it is conventional to use a drum-type rotor. An outer static ring of the static blade assembly is radially keyed to the turbine casing so as to move with the casing. The moving blades have root portions carried within slots in the periphery of the rotor drum.

FIGS. 1 and 1A of the accompanying drawings show a known type of disc and diaphragm arrangement. A turbine rotor 1 comprises a series of discs 2 with annular chambers 3 between them. Each disc 2 carries an annular row of moving blades 4, each having a root 6 fixed to the disc 2 by pins 7. The static blade assembly or diaphragm 8 which is immediately upstream of the disc 2 (with respect to the steam flow direction indicated by the arrows 9) comprises an annular row of static blades 11 extending between a radially outer static ring 12 and a radially inner static ring 13. The outer ring 12 is housed in and axially located by the turbine casing 14 and has an axial extension 16 carrying a fin-type labyrinth seal cooperating with the shrouds 18 of the moving blades 4. In this instance, the labyrinth seal comprises an axial series of circumferentially extending strips 17 whose hooked ends are caulked into an axial extension 16 of the outer static ring. The inner ring 13 (which is more massive than the outer ring 12) is accommodated in the chamber 3 between two discs 2 and carries a fin-type labyrinth seal 19 restricting the leakage flow (indicated by arrows 21) past the diaphragm 8. In this instance, the labyrinth seal 19 comprises an axial series of circumferentially extending, alternately longer and shorter triangular- or knife-section fins that extend from the seal carrier towards sealing lands on the rotor surface. The seal carrier itself is segmented to allow the seal 19 to have a limited degree of self-adjustment in the radial direction.

FIG. 2 of the accompanying drawings shows a known type of turbine with a drum-type rotor 22, the diameter of the periphery 23 being substantially constant. Each annular row of moving blades 24 has the root portions 26 of the blades fixed in circumferentially extending slots in the rotor 22. As in FIG. 1, the shrouds 27 of the moving blades 24 are again sealed to the turbine casing 28 by fin-type labyrinth seals. In each annular row of static blades 29, an outer shroud portion 31 of each blade is individually mounted in a circumferential slot in the casing 28 as shown. Their inner shroud portions 32 are provided with surfaces which are adjacent to fin-type labyrinth seals mounted on the periphery 23 of the rotor 22. A disadvantage of this arrangement is that the outer shroud portions 31 move with the casing 28 as it expands and contracts.

SUMMARY OF THE INVENTION

The present invention provides an axial flow steam turbine assembly including a first, higher pressure turbine and a second, lower pressure turbine, a steam outlet of the first turbine communicating with a steam inlet of the second turbine, wherein:

one of the first and second turbines comprises a plurality of reaction turbine stages, each having an annular row of static blades, which extend between an outer static ring fixed to a turbine casing and an inner static ring, a sealing device acting between the inner static ring and a first rotor drum, and an annular row of moving blades, which have root portions held in peripherally extending slots of the rotor drum; and the other of the first and second turbines comprises at least one turbine stage—referred to as a modified turbine stage—having an annular row of static blades, which extend between an outer static ring and an inner static ring, and an annular row of moving blades, and a rotor drum having peripherally extending slots in which root portions of the moving blades are held, a sealing device acting between the inner static ring and the rotor drum, the outer static ring being axially located in a recess in a turbine casing, and the outer static ring having greater thermal inertia and greater stiffness than the inner static ring and being capable of limited radial movement relative to the turbine casing.

The construction and arrangement of the outer static ring enables it to accommodate out-of-round distortion of the turbine casing relative to the outer static ring. The limited radial movement of the outer static ring relative to the turbine casing may be achieved by cross-key location of the outer static ring within the turbine casing.

The invention also provides a method of modifying an axial flow steam turbine assembly including a first, higher pressure turbine and a second, lower pressure turbine, a steam outlet of the first turbine communicating with a steam inlet of the second turbine, each of the first and second turbines comprising a plurality of reaction turbine stages, each having an annular row of static blades, which extend between an outer static ring fixed to a respective turbine casing and an inner static ring, a sealing device acting between the inner static ring and a respective rotor drum, and an annular row of moving blades, which have root portions held in peripherally extending slots of the respective rotor drum, the method comprising modifying one of the first and second turbines so that it comprises at least one—referred to as a modified turbine stage—turbine stage having an annular row of static blades, which extend between an outer static ring and an inner static ring, and an annular row of moving blades, and a rotor drum having peripherally extending slots in which root portions of the moving blades of the modified turbine stage are held, a sealing device acting between the inner static ring and the rotor drum, the outer static ring being axially located in a recess in a turbine casing of the modified turbine, and the outer static ring having greater thermal inertia and greater stiffness than the inner static ring and being capable of limited radial movement relative to the turbine casing.

It may be possible to re-use the rotor drum and/or the turbine casing and/or to leave some reaction turbine stages in the modified turbine.

The aerodynamic stage design of the modified turbine stage may be impulse or reaction.

BRIEF DESCRIPTION OF THE DRAWINGS

The invention will be described further, by way of example only, with reference to the accompanying drawings, in which.

DETAILED DESCRIPTION

Figure 3:
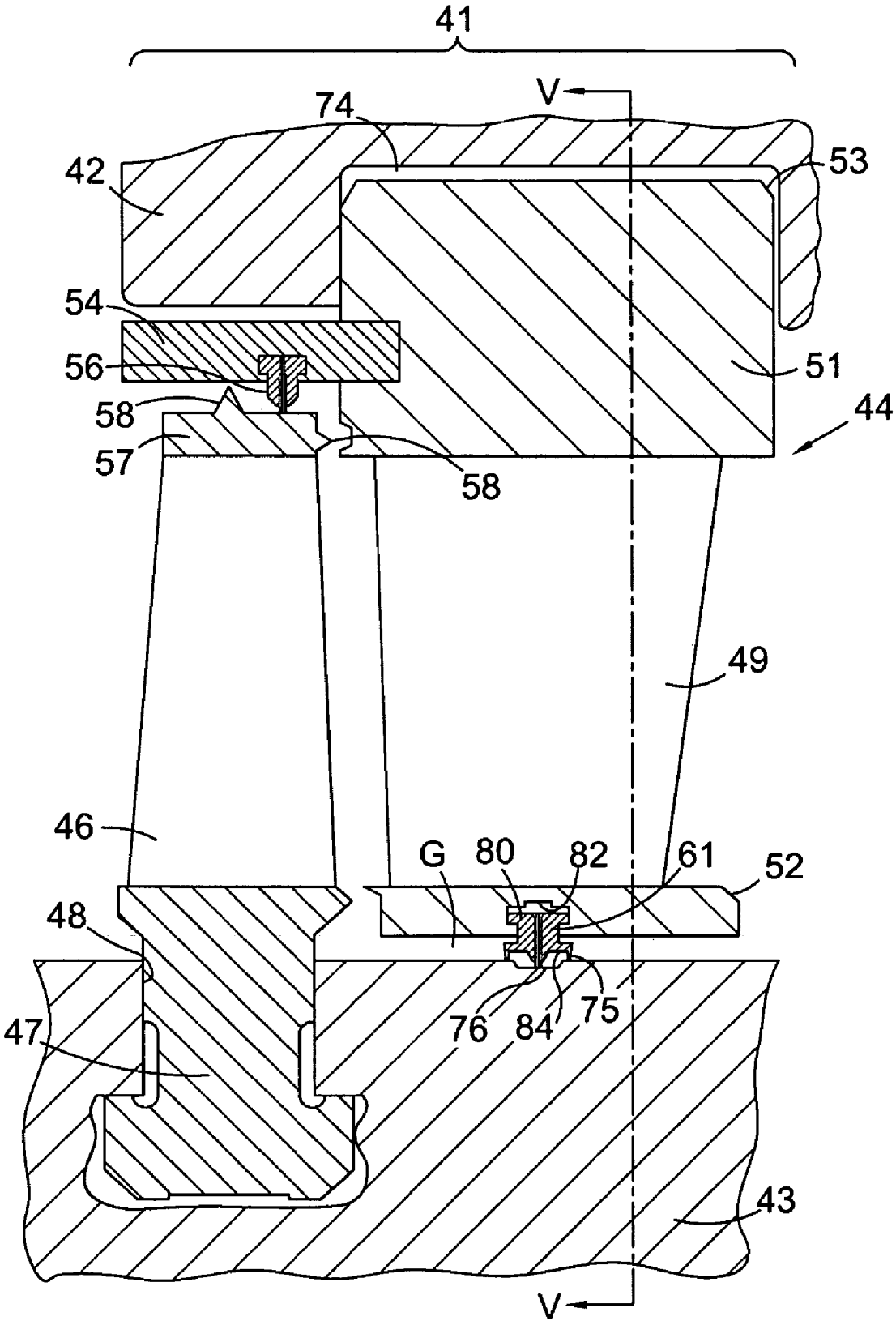
FIG. 3 shows a partial axial section through a modified turbine stage for use in a steam turbine assembly in accordance with the present invention.

Referring to the drawings, FIG. 3 shows a modified turbine stage 41 which is one of a plurality of such stages in a steam turbine comprising a turbine casing 42 surrounding a drum-type rotor 43. In this example the modified turbine stage is an impulse turbine stage. The turbine stage 41 comprises a static blade assembly 44 upstream of an annular row of moving blades 46 having root portions 47 held within a slot 48 in the periphery of the rotor 43. The static blade assembly 44 comprises an annular row of static blades 49 extending between a radially outer static ring 51 and a radially inner static ring 52, the radially inner side of which confronts the periphery of the rotor 43. Both rings 51 and 52 are segmented as necessary for manufacture, assembly and operation of the turbine.

The outer static ring 51 is housed in an annular chamber 53 which is formed in the casing 42 and is open towards the rotor 43, so that the outer ring 51 is axially located by the casing 42 but can move to a limited extent in the radial direction. The outer ring has a high thermal inertia and a high stiffness, in comparison with the inner ring 52, and is capable of sufficient sliding relative to the casing 42 in a radial sense to accommodate thermal expansion and contraction of the casing 42 and the outer ring 51 relative to each other. An advantage of this is that the static blade assembly 44 is not subject to distortion if the casing 42 distorts. This enhances the maintenance of circularity and concentricity between the inner ring 52 and the rotor 43 and the sealing of the inner ring with respect to the rotor.

Figure 5A:
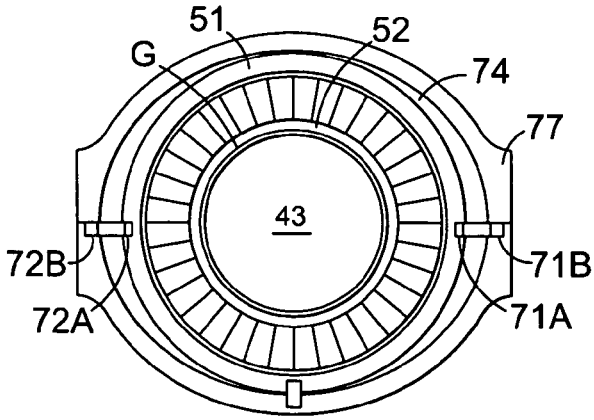
FIGS. 5A and 5B show diagrammatic radial cross-sections taken on line V-V in FIG. 3, showing isolation of the static blade assembly from distortion of an exterior casing of the turbine.
Figure 5B:
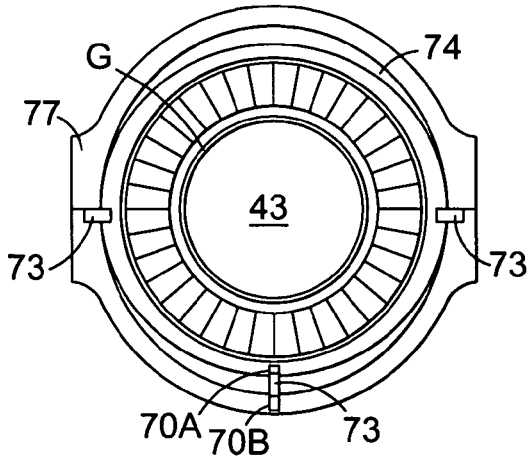

FIGS. 5A and 5B illustrate in an exaggerated manner how the outer static ring 51 is enabled to slide relative to the casing 42 in a radial sense, so avoiding distortion even if the outer turbine casing 42 becomes distorted. FIG. 5A shows out-of-round lateral distortion of the casing 42 and FIG. 5B shows out-of-round vertical distortion. The outer static ring 51 is provided with three axially extending slots or keyways 70A, 71A, and 72A, which confront corresponding keyways 70B, 71B, and 72B in the outer casing 42. One pair of keyways 70A and 70B is located at the lowest part of the outer ring 51 on its vertical centreline, whereas keyway pairs 71A, 71B and 72A, 72B are diametrically opposed to each other on the horizontal centreline. Keys 73 are housed in the keyways and extend across the annular gap 74 between the casing 42 and the ring 51. In this way, the outer static ring 51 is cross-key located within the outer turbine casing 42 and thereby substantially isolated from non-circularity of the casing.

It should also be mentioned that, as indicated in FIG. 5, outer casing 42 is made of two semi-circular halves, which are bolted together at external flanges 77.

The static blade assembly 44 remains circular not only due to the above-described cross-key location of the outer static ring 51 but also due to its strength. Ring 51 is made of two massive semi-circular halves, which are normally bolted together to form an axi-symmetric structure with high circular stiffness. The inner static ring 52 may be segmented in order to help prevent temperature differences between the inner and outer static rings distorting the assembly. In addition, or alternatively, the radially thick outer ring 51 may be thermally matched with the radially thinner inner ring 52, i.e., they are designed so that their rates of thermal expansion and contraction are sufficiently similar to substantially avoid distortion of the static blades 49 as the turbine heats up and cools down during its operating cycles. The ability of the outer static ring 51 to maintain circularity of the whole impulse stage assembly, as described above, enables the bulk and stiffness of the inner static ring to be considerably reduced in comparison with conventional impulse stages employing a diaphragm and chamber type of construction. This gives advantages in turbine construction as explained later.

The outer ring 51 carries an axial extension 54, which in turn carries a seal 56. In this example, seal 56 is a brush seal, but other types of seal could be used, such as fin-type seals. This seal 56 contacts an outer moving shroud ring 57 attached to the tips of the moving blades 46. Furthermore, the shroud ring 57 has triangular- or knife-section fin-type sealing portions 58 which project towards the downstream side of the outer static ring 51 and the radially inner side of the extension 54 respectively.

An efficient annular seal 61, segmented as necessary, acts to minimise leakage of the turbine working fluid through the gap G between the inner static ring 51 and the periphery of the rotor 43. An outer flanged portion 80 of the seal 61 is held within a re-entrant slot 82 in the underside of the inner static ring 52. A radially inner portion 84 of the seal 61 projects from the slot 82 to sealingly engage the rotor drum. Being segmented, the annular seal 61 can slide radially in or out of the slot 82 to a limited extent to accommodate differential thermal growth between the rotor 43 and the inner static ring 52. The seal 61 may be a seal with multiple rigid sealing elements, such as a fin-type labyrinth seal, a seal with flexible sealing elements, such as a brush, foil, or leaf, or a combination of these two types of seal, such as a brush seal combined with a labyrinth seal comprising triangular- or knife-section fins 75, as shown.

In the example of FIG. 3, the bristles of the brush seal contact the rotor 43 in a shallow annular track 76 in the periphery of the rotor. In combination with the labyrinth seal component 75 of the seal 61, this provides a sinuous leakage path—and therefore reduced leakage—for turbine working fluid which escapes from the turbine annulus and passes through the gap G.

Figure 4:
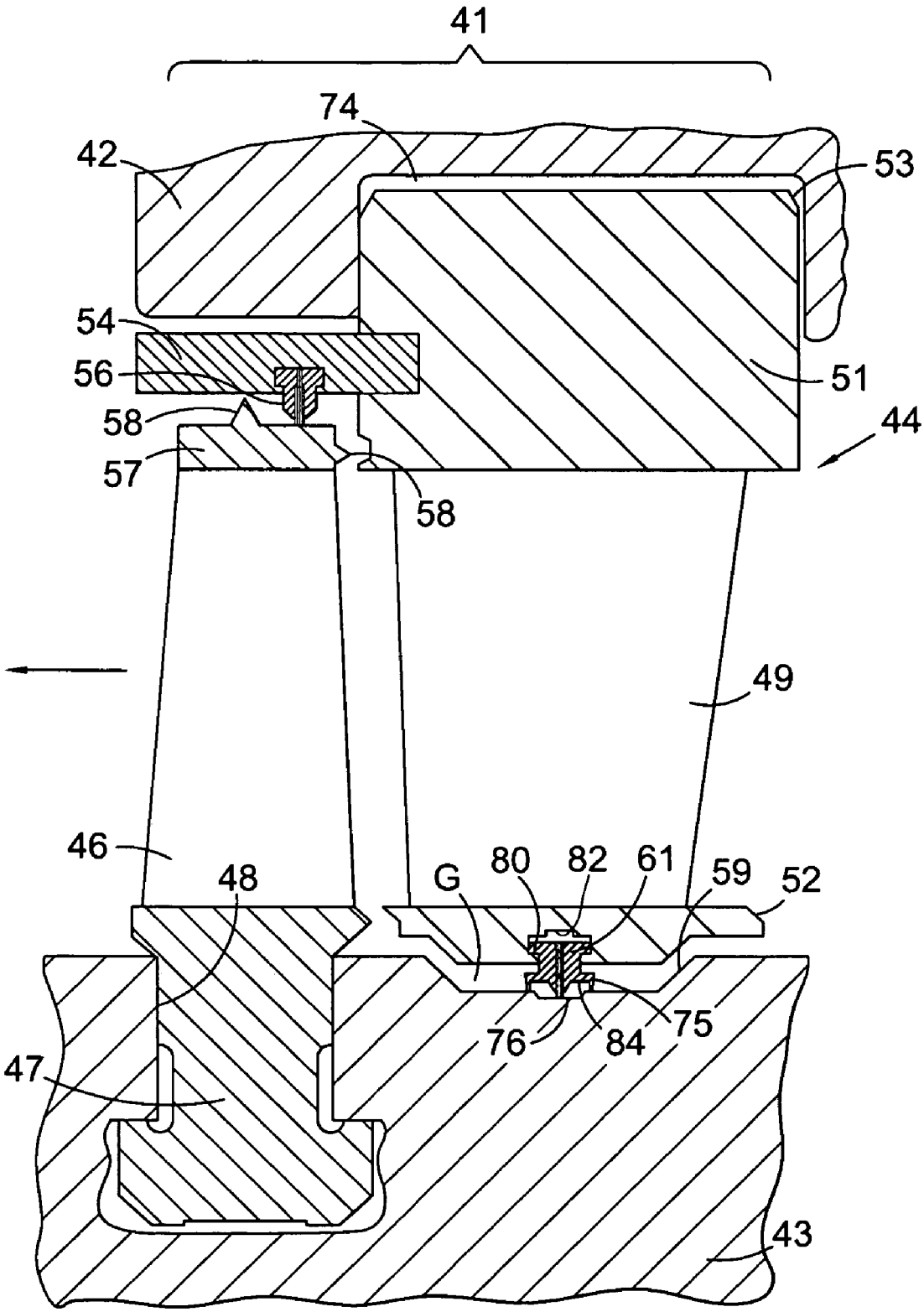
FIG. 4 shows a view similar to FIG. 3, but showing an alternative embodiment of the modified turbine stage.

Referring now to FIG. 4, this shows an alternative in which those components that are similar or identical to those shown in FIG. 3 are given the same references and will not be described again. The major difference of FIG. 4 from FIG. 3 is that the part of the periphery of the rotor 43 confronting the inner ring 52 has an annular recess 59, the axial ends of which are spaced from each of the adjacent rows of moving blades 46 (only one of which is shown). The annular recess 59 provides a significantly reduced-diameter drum portion over part of the axial distance between adjacent rows of moving blades. As shown, the inner static ring 52 is somewhat more massive in this example as compared with FIG. 3 (though much less massive than a traditional diaphragm construction), and part of its radially inner side projects into the annular recess 59, thereby providing a constricted and radially stepped or sinuous leakage path for turbine working fluid which escapes from the turbine annulus and passes through the gap G between the underside of the static ring 52 and the outside of the rotor 43. As previously mentioned in connection with the bristle track 76, such a stepped or sinuous leakage path increases its resistance to passage of the turbine working fluid therethrough.

As has already been said, the annular recess 59 provides a significantly reduced-diameter drum portion, but it is here emphasised that unlike the conventional diaphragm-type of steam turbine construction, the radial depth of the annular recess 59 is less than the depth of the slot 48, preferably substantially less, e.g., the annular recess 59 may be approximately ¾, ⅔, ½, ⅓, ¼, or even less than ¼ of the depth of the slot 48. In this particular embodiment, it is a little less than ¼ of the depth of the slot. Various design criteria will be used to decide whether to incorporate one or more recesses 59 into the drum rotor 43, and if so, how deep to make each recess. One criterion may be the desired strength and rigidity of the inner static ring 52. Another criterion may be the degree of thermal matching that is considered desirable between the outer and inner static rings 51, 52 to avoid distortion of the blades 49 during working conditions in the turbine. This criterion will affect the dimensions and mass of the inner static ring.

An advantage of the arrangement of FIG. 4 is that the annular recess 59 is formed by removing low stressed and therefore redundant material from the drum periphery between the rows of moving blades without hazarding blade retention, while providing increased sealing efficiency due to the reduced drum diameter. Furthermore, the provision of the annular recess 59 enables the radial extent of an efficient seal 61 to be accommodated wholly or partly within the outer envelope of the drum-type rotor 43.

Figure 6:
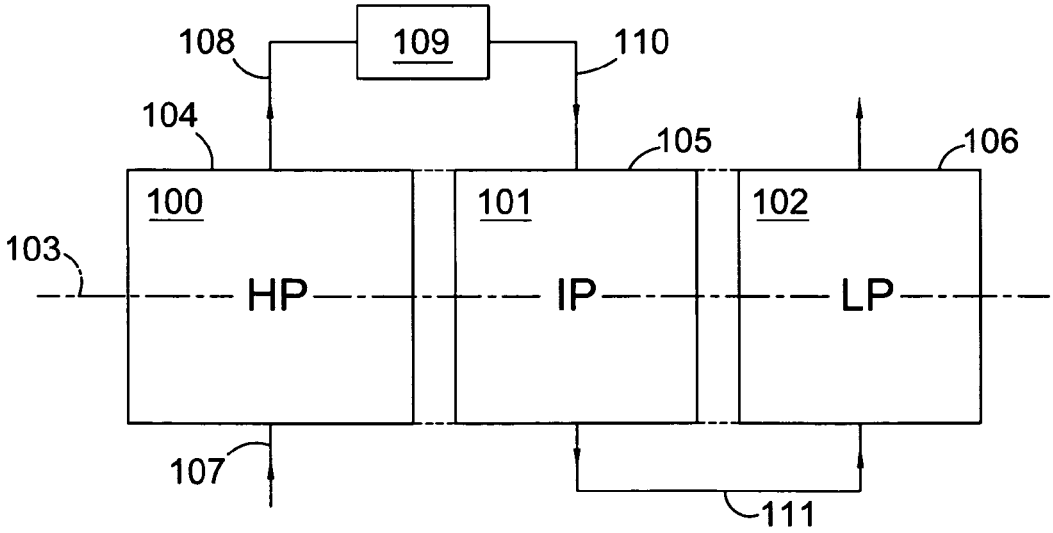
FIG. 6 shows a diagram of an axial flow steam turbine assembly comprising a high pressure turbine, an intermediate pressure turbine, and a low pressure turbine.

FIG. 6 schematically illustrates a turbine assembly comprising a high pressure (HP) steam turbine 100, an intermediate pressure (IP) steam turbine 101, and a low pressure (LP) steam turbine 102, which are physically and fluidically connected, having a common axis 103. The turbines 100-102 have separate casings 104-106. However, as indicated by the chain-dotted lines connecting the casings 104-106, any two of them (in particular 104 and 105), or all three, could be combined as a single casing structure. An HP steam line 107 from a boiler (not shown) enters an inlet of the HP turbine 104 and leaves at a lower pressure through an outlet line 108. The steam is then re-heated in a heat exchanger 109 (associated with the boiler) before being injected into an inlet of the IP turbine 101 via an IP line 110. Steam leaving the IP turbine 101 is fed into the LP turbine 106 via an LP line 111.

Figure 7:
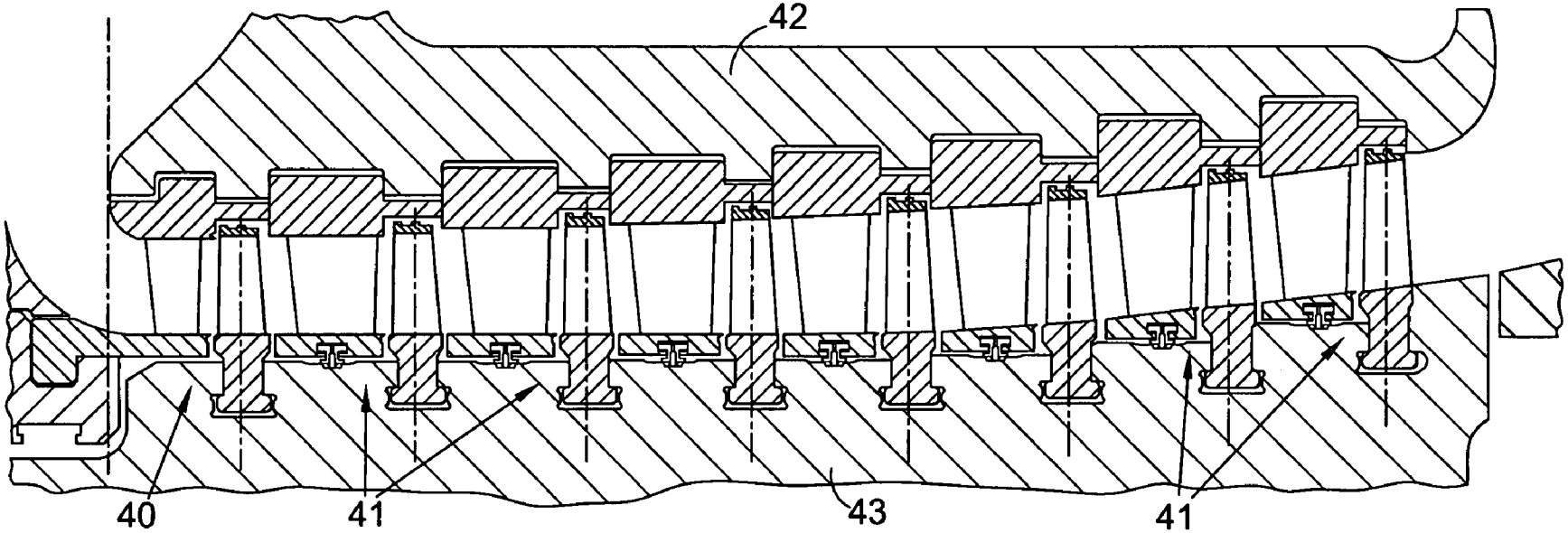
FIG. 7 shows a partial axial section through a steam turbine which is suitable for use as the HP or IP turbine in FIG. 6 and which comprises a plurality of modified turbine stages similar to the one shown in FIG. 3.

FIG. 7 shows an HP or IP turbine incorporating seven of the modified turbine stages 41 as described above with reference to FIG. 3, preceded by a similar turbine stage 40.

Figure 8:
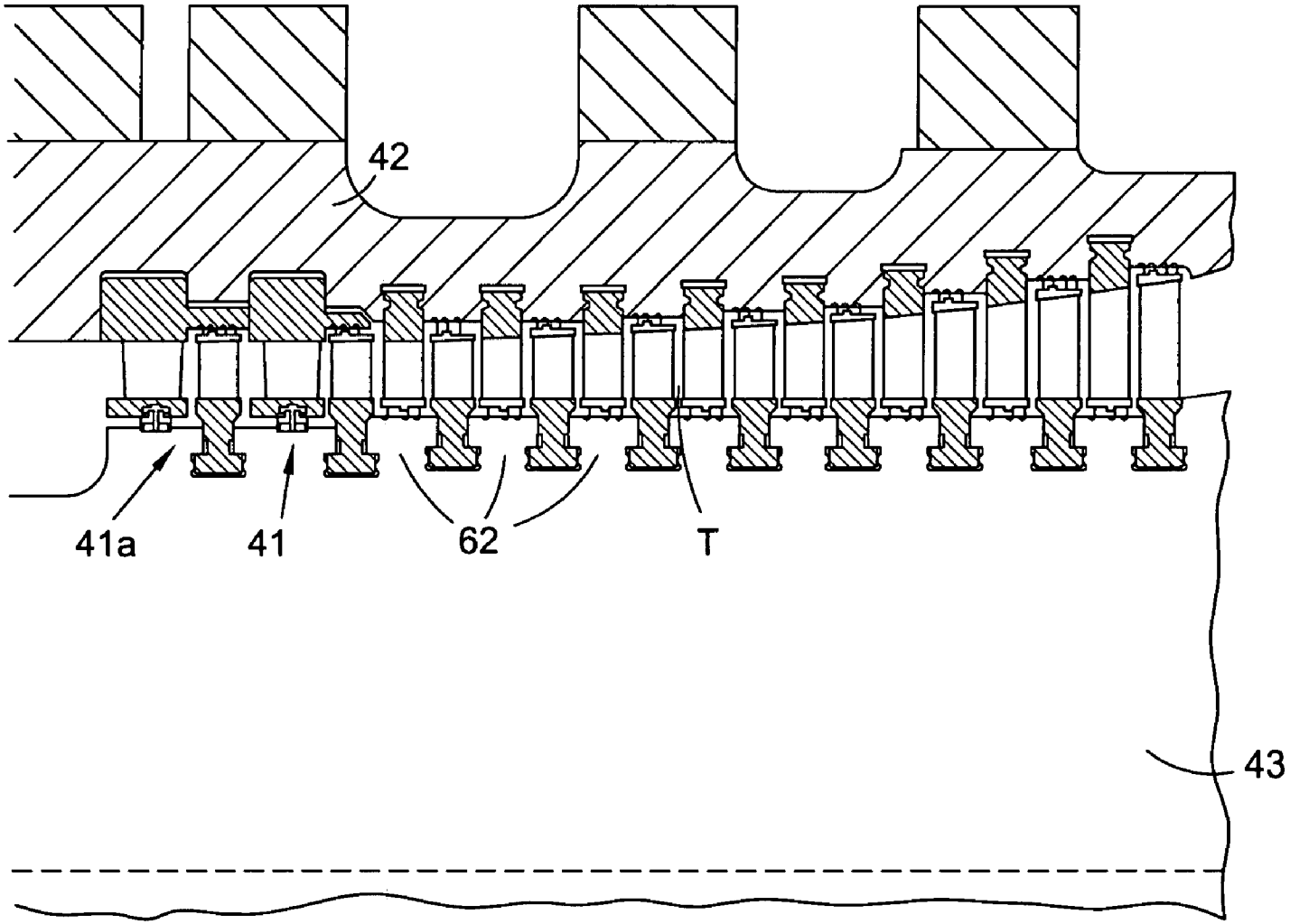
FIG. 8 shows a partial axial section through a steam turbine which is suitable for use as the HP or IP turbine in FIG. 6 and which comprises two modified turbine stages similar to the one shown in FIG. 3 and a plurality of conventional reaction turbine stages similar to those shown in FIG. 2.

FIG. 8 shows an HP or IP steam turbine incorporating a modified turbine stage 41 as described with reference to FIG. 3 above, preceded by a similar turbine stage 41*a* and followed by a series of reaction turbine stages 62. All these stages have the same constant inner diameter of the turbine passage annulus T throughout their axial extent, aiding cheapness of manufacture due to commonality of dimensions.

Figure 2:
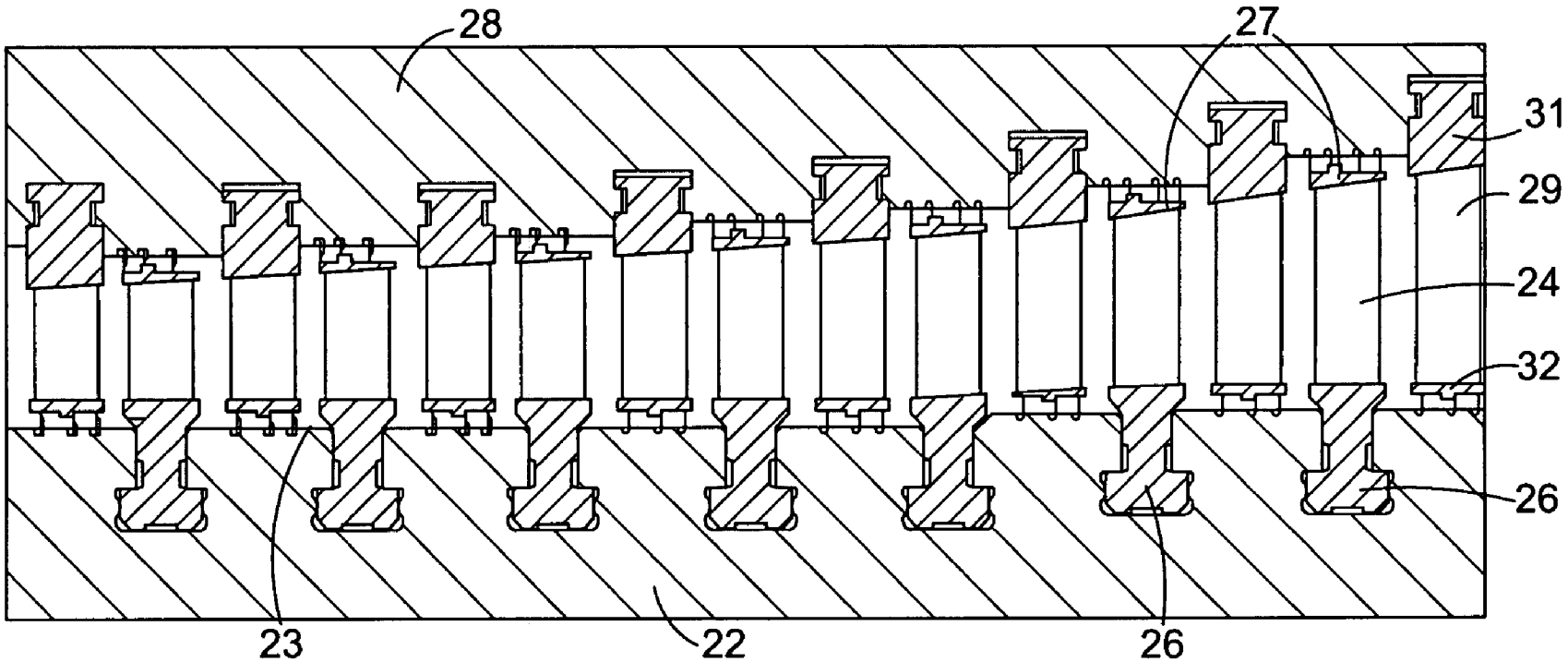
Fig. 2 (Prior Art)
FIG. 2 shows a partial axial section through a known type of reaction steam turbine, with a plurality of conventional reaction turbine stages.

Considered in isolation from the modified stages 41 and 41*a*, the reaction stages 62 are substantially as previously described in relation to FIG. 2. However, it should be noted that because the inner static rings of the modified stages are less massive and bulky than those in the diaphragms usually required for such stages, both the modified stages and reaction stages are able to share the same drum-type rotor, the diameter of the drum adjacent the inner static rings of the modified stages as shown in FIG. 8 being only slightly less than (i.e., substantially the same as) the diameter of the drum adjacent the inner static rings of the reaction stages. Furthermore, if a configuration like that of FIG. 4 were to be used for stages 41*a* and 41, exactly (rather than substantially) the same outer drum diameter could be maintained as between the two types of stages if desired, with the inner static shrouds and their associated seals being at least partially housed in the annular recesses provided in the drum 43.

Figure 9:
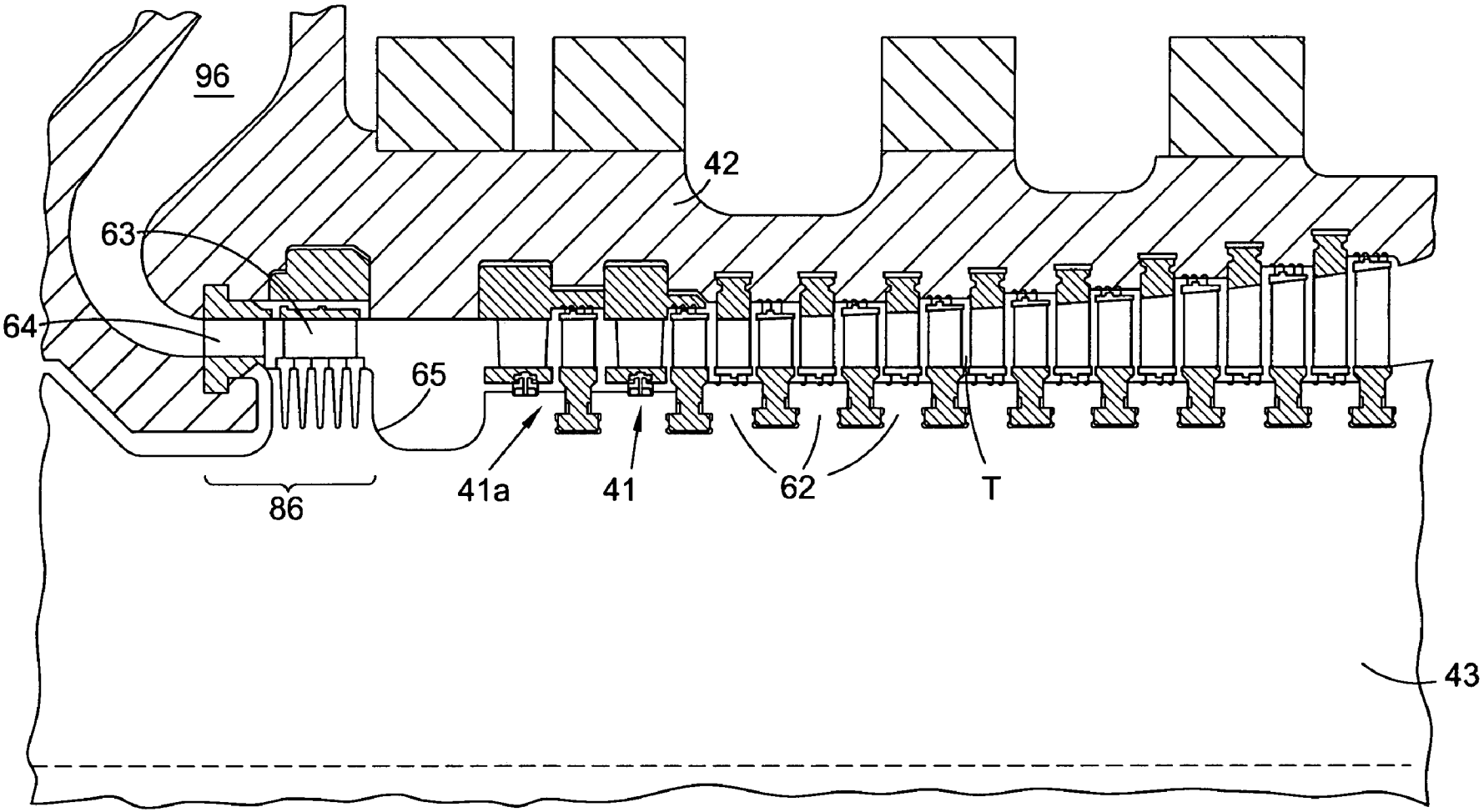
FIG. 9 shows a view similar to FIG. 8, with the addition of a control stage making the turbine particularly suitable for use as the HP turbine in FIG. 6.

FIG. 9 shows a turbine suitable for use as an HP turbine since the turbine stages 41*a*, 41, 62 follow a control stage 86. The control stage 86 has moving impulse blading 63 and a steam inlet comprising static nozzle blades 64 preceding the moving blades 63. The control stage 86 is further provided with a valve assembly (not shown) which controls the flow of steam through the nozzle passages between the nozzle blades 64, and hence through the row of impulse blading 63. Steam enters the turbine through supply lines provided with master valves to turn the total high pressure steam supply on or off, or to throttle it. Three smaller valves are also provided to control steam input to three different steam inlet passages, one of which, 96, is shown in FIG. 9. These steam inlet passages supply corresponding circumferentially extending sectors of the control stage 86, i.e., a top sector shown in axial section in FIG. 9, and two side sectors.

Note with respect to FIGS. 8 and 9 that the modified stages 41*a* and 41 are placed immediately upstream of the series of reaction stages 62 because they are more robust than the reaction stages and therefore better able to withstand the effects of the steam pressure and any temperature and aerodynamic stresses imposed by differential admission of steam into the three sectors of the control stage. To ameliorate the effects of such differential admission around the circumference of the turbine, a radially and axially extending equilibration chamber 65 separates the rest of the high pressure turbine from the control stage 86 in FIG. 9.

Figure 10:
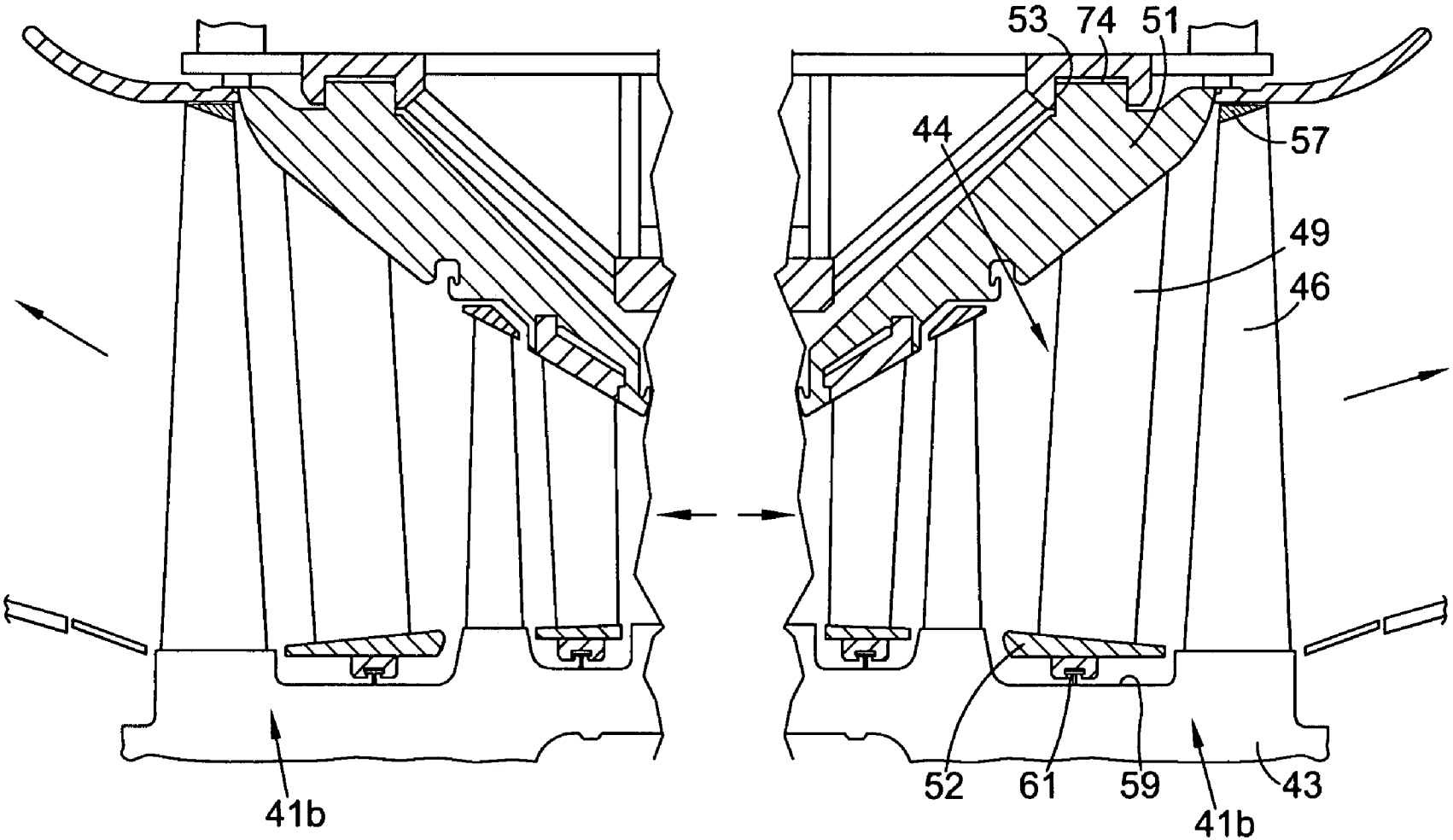
FIG. 10 shows a partial axial section through a steam turbine which is suitable for use as the LP turbine in FIG. 6 and which comprises modified turbine stages.

FIG. 10 shows an LP steam turbine comprising a plurality of modified turbine stages 41*b* generally similar to that described with reference to FIG. 4. Similar parts are given the same reference numerals. The LP turbine shown is a double-flow LP turbine in which the LP steam enters centrally and expands in both axial directions. In the regions (not shown) near the centre the LP turbine has either further modified turbine stages or conventional reaction turbine stages similar to those described with reference to FIG. 2.

Figure 11:
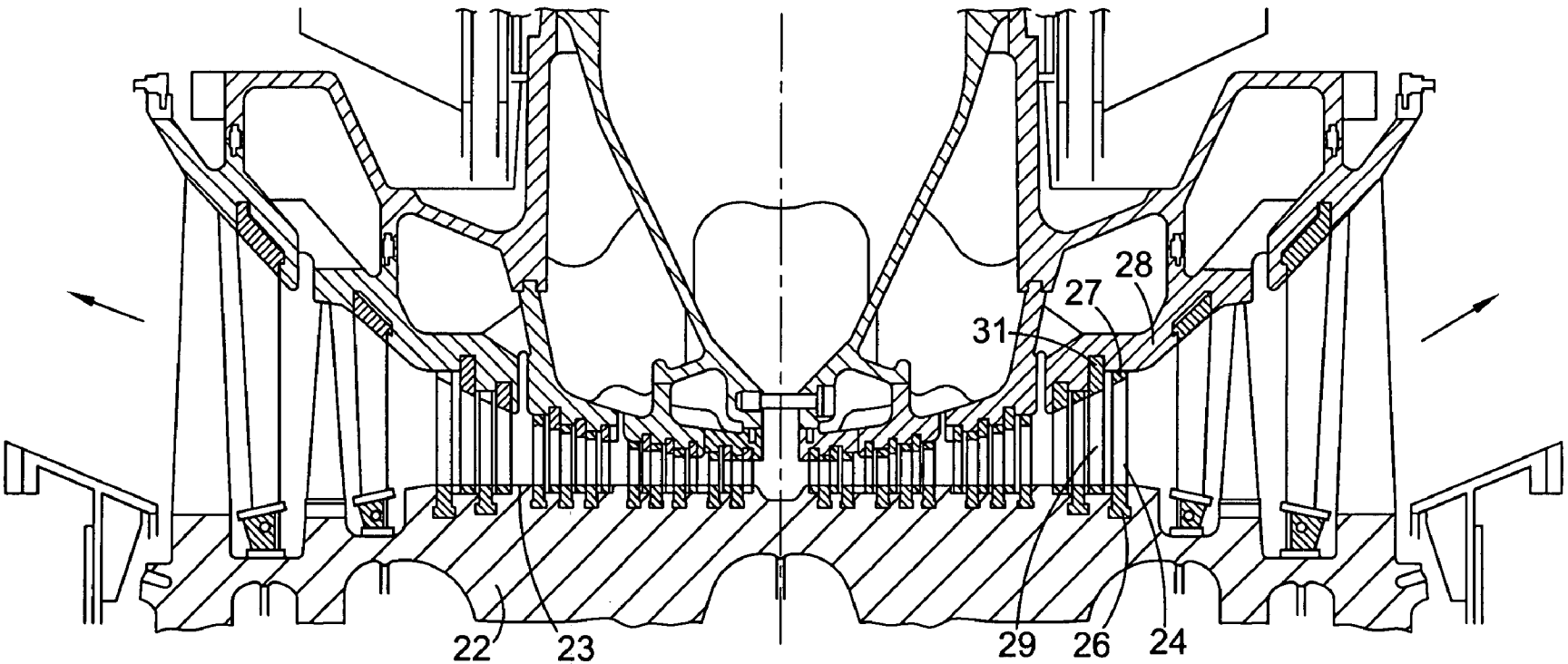
FIG. 11 shows a partial axial section through a steam turbine which is suitable for use as the LP turbine in FIG. 6 and which comprises a plurality of conventional reaction turbine stages.

FIG. 11 shows a conventional double-flow LP turbine comprising a plurality of conventional reaction turbine stages. Similar parts are given the same reference numerals as in FIG. 2.

Figure 1:
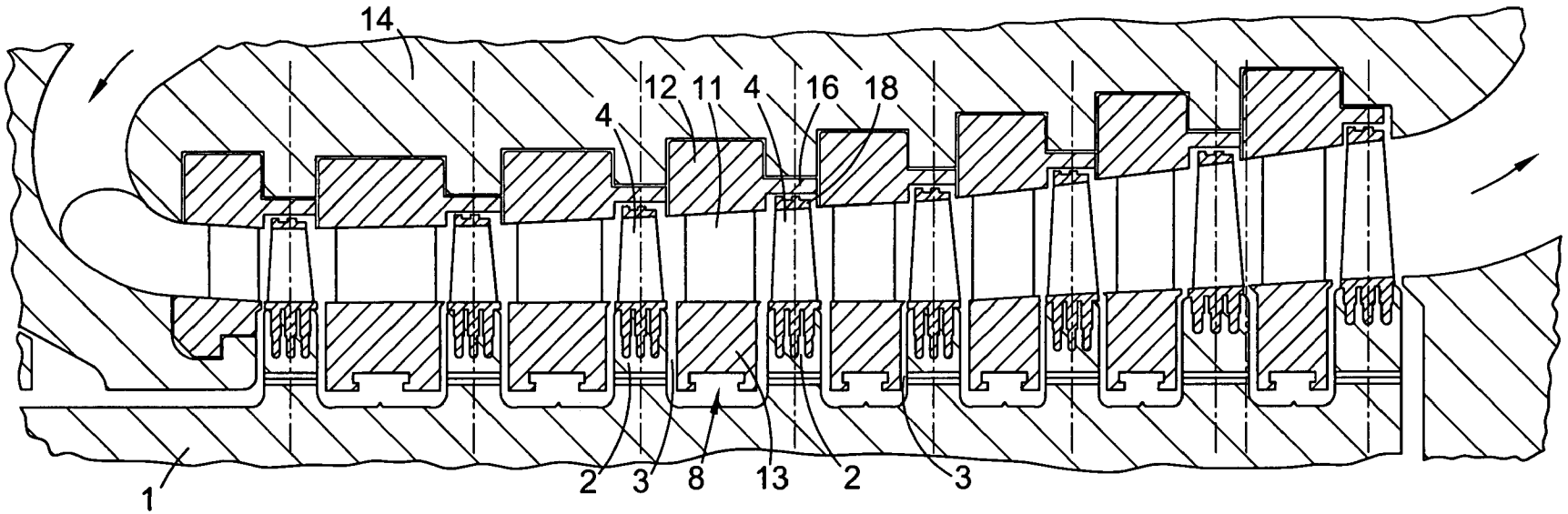
Fig. 1 (Prior Art)
FIG. 1 shows a partial axial section through one known type of impulse steam turbine, with a plurality of conventional impulse turbine stages.
Figure 1A:
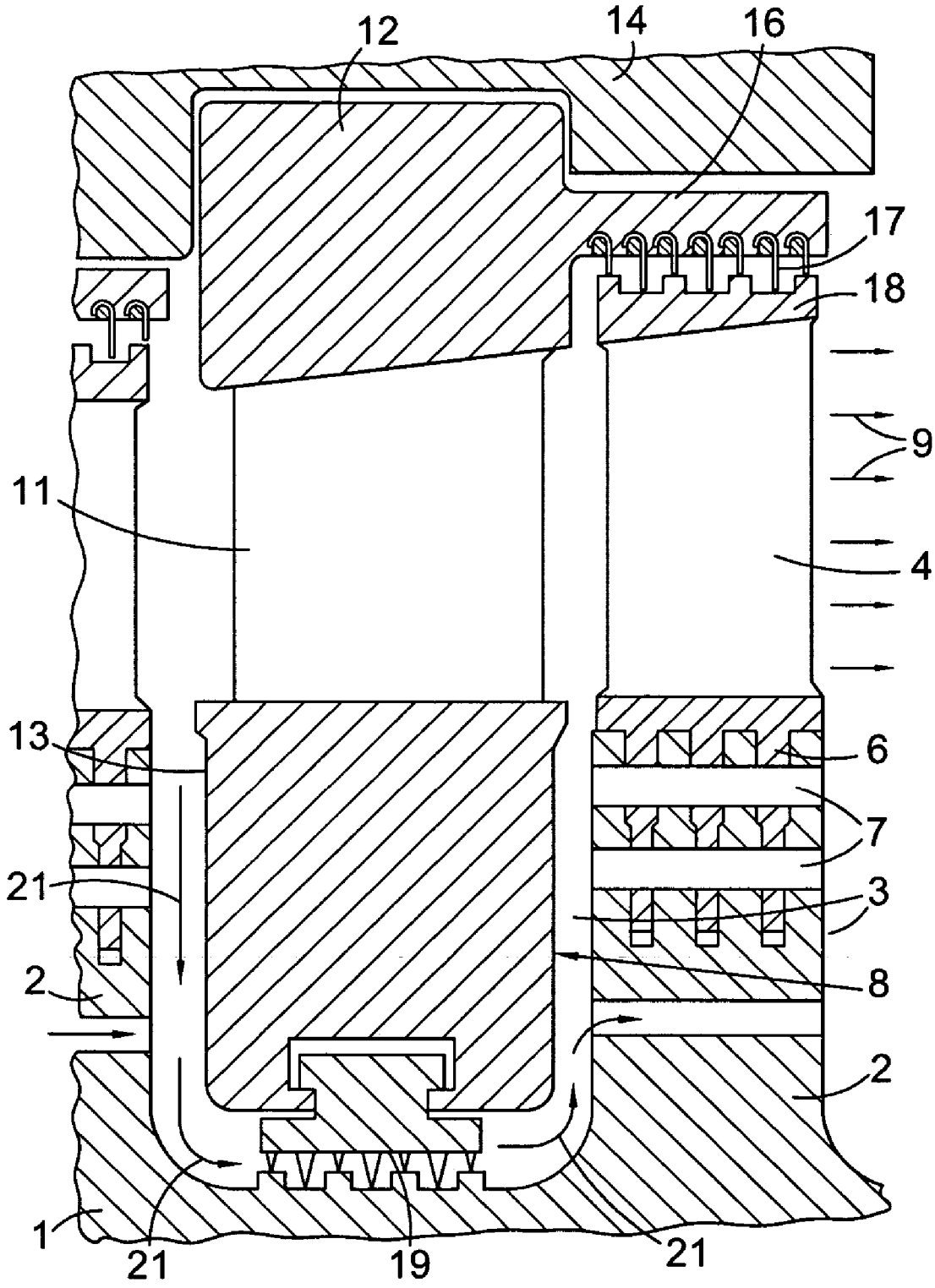
Fig. 1A (PRIOR ART)
FIG. 1A shows an enlarged view of one of the turbine stages of FIG. 1.
Figure 12:
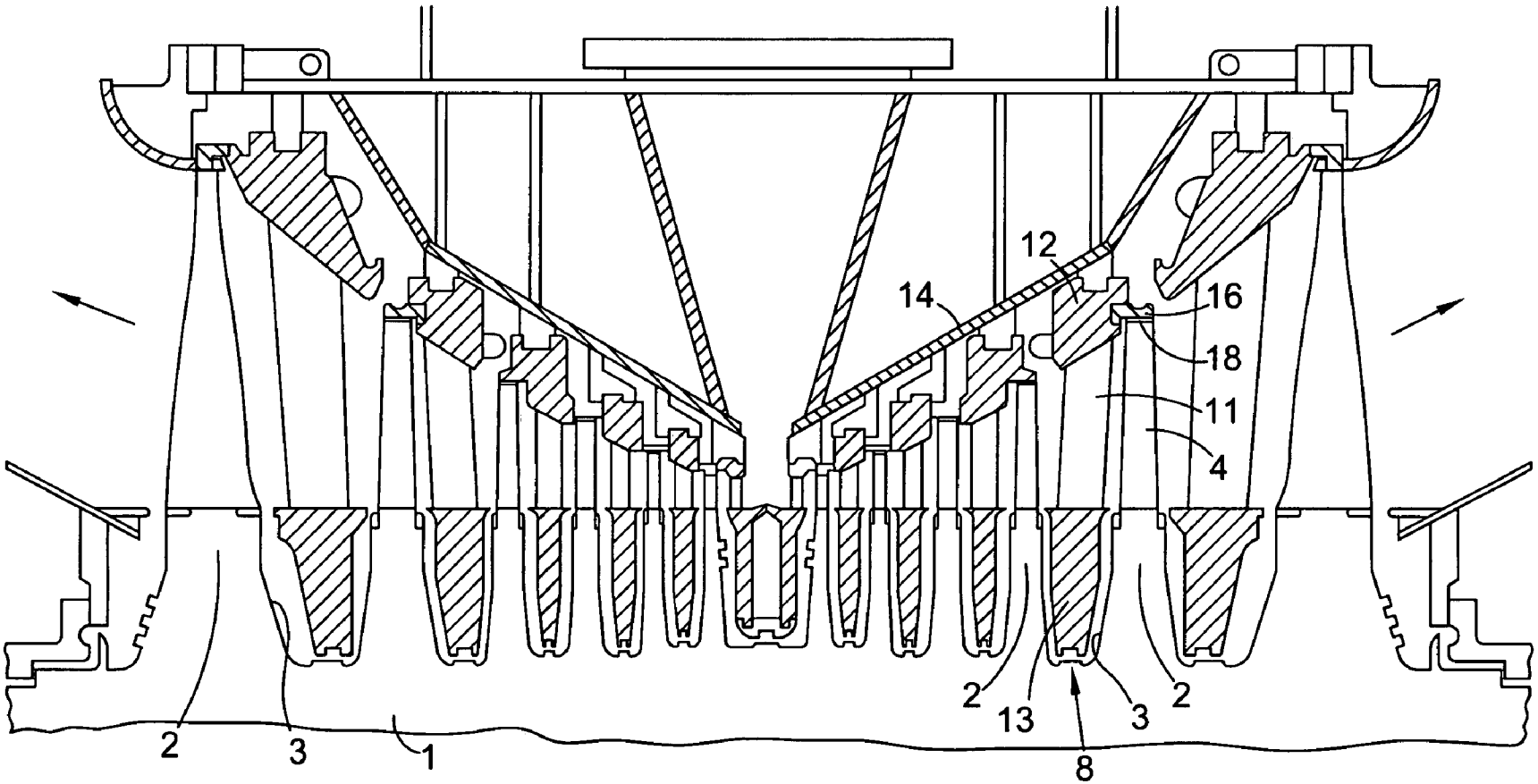
Fig. 12 (Prior Art)
FIG. 12 shows a partial axial section through a steam turbine which is suitable for use as the LP turbine in FIG. 6 and which comprises a plurality of conventional impulse turbine stages.

FIG. 12 shows a conventional double-flow LP turbine comprising a plurality of conventional impulse turbine stages. Similar parts are given the same reference numerals as in FIG. 1.

It should be noted that in the global market for heavy-duty steam turbines, customers often have a clear preference for turbine constructions of the conventional impulse diaphragm type. The reasons for this, as compared with conventional reaction (drum-type) designs, include:

reduced deterioration of clearances due to the greater stiffness of diaphragms, ease of on-site clearance adjustments, since these can be done one turbine stage at a time, and reduced maintenance costs due to both of the preceding factors and due to easy repair and refurbishment of components.

On the other hand, drum-type high reaction turbines have advantages such as reduced costs of original material and manufacture, combined with a more compact design to maximise power density.

Preferred embodiments of a turbine assembly in accordance with the present invention will now be described.

Embodiment 1

Referring to FIG. 6, the first exemplary embodiment comprises an HP steam turbine 100 having a conventional drum-type structure with reaction turbine stages, as described above with reference to FIG. 2, and an IP steam turbine 101 having a drum-type structure with modified turbine stages, as described with reference to FIG. 7.

An advantage of this is that a drum-type construction is used for both turbines 100,101. An existing turbine assembly with an IP turbine of conventional drum-type construction can be modified by replacing the conventional reaction-type blading with the modified blading. The modified turbine stages, with cross-key location, give enhanced maintenance of circularity.

Any suitable type of LP steam turbine may be used or the LP turbine 102, in particular any of the LP turbines described with reference to FIGS. 10 to 12, drum-type turbines being preferred.

Embodiment 2

The second exemplary embodiment is the same as Embodiment 1 except that the IP steam turbine 101 has a drum-type structure with modified turbine stages and reaction turbine stages, as described with reference to FIG. 8. This has the advantage of lower cost, the casing-mounted static blades of the reaction turbine stages being cheaper.

Embodiment 3

The third exemplary embodiment comprises an IP steam turbine 101 having a conventional drum-type structure with reaction turbine stages, as described above with reference to FIG. 2, and an LP steam turbine 102 having a drum-type structure with modified turbine stages, as described with reference to FIG. 10.

An advantage of this is that a drum-type construction is used for both turbines 101,102. An existing turbine assembly with an LP turbine of conventional drum-type construction can be modified by replacing the conventional reaction-type blading with the modified blading. The modified turbine stages, with cross-key location, give enhanced maintenance of circularity.

Any suitable type of HP steam turbine may be used as the HP turbine 100, in particular any of the HP turbines described with reference to FIGS. 1, 2, 7, 8, and 9, drum-type turbines being preferred.

Embodiment 4

The fourth exemplary embodiment comprises an HP steam turbine 100 having a drum-type structure with modified turbine stages, as described with reference to FIG. 7, and an IP steam turbine 101 having a conventional drum-type structure with reaction turbine stages, as described above with reference to FIG. 2.

An advantage of this is that a drum-type construction is used for both turbines 100,101. An existing turbine assembly with an HP turbine of conventional drum-type construction can be modified by replacing the conventional reaction-type blading with the modified blading. The modified turbine stages, with cross-key location, give enhanced maintenance of circularity.

Any suitable type of LP steam turbine may be used or the LP turbine 102, in particular any of the LP turbines described with reference to FIGS. 10 to 12, drum-type turbines being preferred.

Embodiment 5

The fifth exemplary embodiment is the same as Embodiment 4 except that the HP steam turbine 100 has a drum-type structure with modified turbine stages and reaction turbine stages, as described with reference to FIG. 8 or, preferably, FIG. 9.

Embodiment 6

The sixth exemplary embodiment comprises an IP steam turbine 101 having a drum-type structure with modified turbine stages, as described with reference to FIG. 7, and an LP steam turbine 102 having a conventional drum-type structure with reaction turbine stages, as described above with reference to FIG. 11.

An advantage of this is that a drum-type construction is used for both turbines 101,102. An existing turbine assembly with an IP turbine of conventional drum-type construction can be modified by replacing the conventional reaction-type blading with the modified blading. The modified turbine stages, with cross-key location, give enhanced maintenance of circularity.

Any suitable type of HP steam turbine may be used as the HP turbine 100, in particular any of the HP turbines described with reference to FIGS. 1, 2, 7, 8, and 9, drum-type turbines being preferred.

Embodiment 7

The seventh exemplary embodiment is the same as Embodiment 6 except that the IP steam turbine 102 has a drum-type structure with modified turbine stages and reaction turbine stages, as described with reference to FIG. 8.

In each of the above-described exemplary embodiments, the turbine casings of the HP and IP turbines are preferably combined to form a single casing structure, and the turbine casing of the LP turbine is preferably a separate casing structure, the rotors of the turbines being arranged on a common axis.

What is claimed is:

1. An axial flow steam turbine assembly, comprising:

a first turbine having a first rotor drum, a first turbine casing, a first steam outlet and a plurality of first reaction turbine stages, each first reaction turbine stage having an annular row of first static blades extending between a first outer static ring fixed to the first turbine casing and a first inner static ring, a first sealing device acting between the first inner static ring and the first rotor drum, and an annular row of first moving blades having first root portions held in first peripherally extending slots of the first rotor drum; and a second turbine having a second rotor drum, a second turbine casing, a second steam inlet communicating with the first steam outlet, and at least one modified turbine stage having an annular row of second static blades extending between a second outer static ring and a second inner static ring, an annular row of second moving blades having second root portions held in second peripherally extending slots of the second rotor drum, a second sealing device acting between the second inner static ring and the second rotor drum, the second outer static ring being axially located in a recess in the second turbine casing, wherein the second outer static ring has greater thermal inertia and greater stiffness than the second inner static ring and is capable of limited radial movement relative to the second turbine casing, and wherein one of the first and second turbines is a higher pressure turbine, and the other of the first and second turbines is a lower pressure turbine.

2. The turbine assembly as recited in claim 1, wherein the first and second turbine casings are integrally joined as a single turbine casing.

3. The turbine assembly as recited in claim 1, wherein the second rotor drum includes an annular recess axially spaced from the second peripherally extending slots and having a radial depth less than that of the second peripherally extending slots, the second sealing device extending into the annular recess such that a radial extent of the second sealing device is at least partly within the outer envelope of the rotor drum.

4. The turbine assembly as claimed in claim 3, in which a radially inner portion of the second inner static ring projects into the annular recess.

5. The turbine assembly as recited in claim 3, in which the annular row of second static blades is disposed between the row of second moving blades and a row of further moving blades, and the annular recess is axially spaced from the row of second moving blades and the row of further moving blades.

6. The turbine assembly as recited in claim 1, wherein the second outer static ring is cross-key located within the second turbine casing to facilitate the limited radial movement of the outer static ring relative to the turbine casing.

7. The turbine assembly as recited in claim 1, wherein the second sealing device includes a plurality of sealing elements.

8. The turbine assembly as recited in claim 1, wherein the second sealing device is carried by the second inner static ring.

9. The turbine assembly as recited in claim 1, wherein the annular row of second moving blades include a radially outer moving shroud ring in sealing relationship with an axial extension of the second outer static ring.

10. The turbine assembly as recited in claim 9, wherein a shroud sealing device projects from the axial extension of the second outer static shroud ring towards the radially outer moving shroud ring so as to provide a sealing contact with the shroud ring.

11. The turbine assembly as recited in claim 10, wherein the shroud sealing device includes at least one of a brush seal and a fin-type seal.

12. The turbine assembly as recited in claim 1, wherein the sealing device includes at least one of a brush seal and a fin-type seal.

13. The turbine assembly as recited in claim 1, wherein the second turbine includes at least one second reaction turbine stage following the at least one modified turbine stage.

14. The turbine assembly as recited in claim 13, in which the at least one modified turbine stage and the at least one reaction stage have a turbine passage annulus of axially constant inner diameter.

15. The turbine assembly as recited in claim 1, wherein the first turbine is the higher pressure turbine.

16. The turbine assembly as recited in claim 1, wherein the second turbine is the higher pressure turbine.

17. The turbine assembly as recited in claim 1, further comprising further turbine connected in sequence with the first turbine and the second turbine with respect to a steam flow so as to provide a high pressure turbine, a low pressure turbine and an intermediate pressure turbine, wherein the first and second turbines are the high pressure and intermediate pressure turbines, respectively, or the intermediate pressure and low pressure turbines, respectively.

18. The turbine assembly as recited in claim 1, wherein the first and second turbines have a common axis.

19. The turbine assembly as recited in claim 1, wherein the modified turbine stage is an impulse stage.

20. A method of modifying an axial flow steam turbine assembly including a first, higher pressure turbine and a second, lower pressure turbine, a steam outlet of the first turbine communicating with a steam inlet of the second turbine, each of the first and second turbines comprising a plurality of reaction turbine stages, each having an annular row of static blades, which extend between an outer static ring fixed to a respective turbine casing and an inner static ring, a sealing device acting between the inner static ring and a respective rotor drum, and an annular row of moving blades, which have root portions held in peripherally extending slots of the respective rotor drum, the method comprising:

modifying one of the first and second turbines so as to provide at least one modified turbine stage having an annular row of second static blades, which extend between a second outer static ring and a second inner static ring, and an annular row of second moving blades, and a second rotor drum having second peripherally extending slots in which root portions of the second moving blades of the modified turbine stage are held, a second sealing device acting between the second inner static ring and the second rotor drum, the second outer static ring being axially located in a recess in a second turbine casing of the modified turbine, and the second outer static ring having greater thermal inertia and greater stiffness than the second inner static ring and being capable of limited radial movement relative to the second turbine casing.

21. The method as recited in claim 20, wherein the second rotor drum is formed from the rotor drum of one of the first and second turbines.

22. The method as recited in claim 20, wherein the second turbine casing of the modified turbine is formed from the turbine casing of at least one of the first and second turbines.

23. The method as recited in claim 20, wherein the modified one of the first and second turbines includes at least one reaction turbine stage in addition to the at least one modified turbine stage.

24. The method as recited in claim 20, wherein the modified turbine is part of a turbine assembly including a high pressure turbine, an intermediate pressure turbine, and a low pressure turbine.

* * * * *